US006027378A

United States Patent [19]

Abe et al.

[11] Patent Number: 6,027,378

[45] Date of Patent: Feb. 22, 2000

[54] COMBINED-TYPE CONNECTOR

[75] Inventors: Kimihiro Abe; Tetsuya Yamashita, both of Shizuoka, Japan

[73] Assignee: Yazaki Corporation, Tokyo, Japan

[21] Appl. No.: 09/172,251

[22] Filed: Oct. 14, 1998

[30] Foreign Application Priority Data

Oct. 17, 1997 [JP] Japan ..... 9-285091

[51] Int. Cl.[7] ..... H01R 13/502

[52] U.S. Cl. ..... 439/701; 439/374; 439/686; 439/695; 403/375; 403/380

[58] Field of Search ..... 403/375, 380, 403/326, 329, 281, 331, 339, 340; 439/701, 374, 686, 695

[56] References Cited

U.S. PATENT DOCUMENTS

| | | | |
|---|---|---|---|
| 5,219,242 | 6/1993 | Liaw | 403/375 X |
| 5,421,746 | 6/1995 | David | 439/701 |
| 5,437,564 | 8/1995 | Lignelet | 439/701 |
| 5,643,015 | 7/1997 | Wakata | 439/701 |
| 5,725,397 | 3/1998 | Fukamachi et al. | 439/701 |
| 5,803,651 | 9/1998 | Saito | 403/329 |

FOREIGN PATENT DOCUMENTS

| | | | |
|---|---|---|---|
| 2077052 | 12/1981 | United Kingdom | 439/695 |

*Primary Examiner*—Lynne H. Browne
*Assistant Examiner*—John R. Cottingham
*Attorney, Agent, or Firm*—Armstrong, Westerman, Hattori, McLeland and Naughton

[57] ABSTRACT

A combined-type connector consists of a hood having at the front half a first connector-fitting chamber and at the rear half a side opening in a direction perpendicular to a connector-fitting direction; and a connector with a connector-fitting section having a second connector-fitting chamber formed therein. The connector-fitting section of the connector is inserted through the side opening into combination with the hood, moved in the direction perpendicular to the connector-fitting direction in which the connector is fitted with a mating connector. The hood and the connector can be easily combined and disassembled, though not disassembled under a force acting in the detaching direction of the connector from the mating connector.

9 Claims, 6 Drawing Sheets

COMBINED-TYPE CONNECTOR

BACKGROUND OF THE INVENTION

1. Field of the Invention

This invention relates to a combined-type connector in which the connector-fitting section of a connector is laterally inserted into, and combined with, a hood into which a mating connector is fittable.

2. Description of the Related Art

FIG. 11 shows a conventional combined-type connector proposed in Japanese UM Application Unexamined Publication No. Hei 2-115252.

The combined-type connector 100 consists of a connector 101 of synthetic resin, male terminals inserted into the connector 101, and a hollow rectangular hood 103 of synthetic resin fittable over a forward end portion 102 of the connector 101.

The connector 101 consists of two upper and lower dividably joined housings 104 and a cover 105 provided over the upper housing 104. Male terminals are at their wire-connecting sides received in terminal-accommodating chambers 106 of each housing 104, with their male contact tabs 107 protruding forwardly from the terminal-accommodating chambers 106. Towards its forward end, the connector 101 has a flange for stopping the hood 103.

The hood 103 is of such size and shape as to fit over the forward end portion 102 of the connector 101. The hood 103 is fitted in a connector-fitting direction to the connector 101, i.e., in a direction Y in which the connector 101 is fitted to a mating male connector (not shown). The inside space 109 of the hood 103 serves as a fitting chamber for the mating male connector. On inner walls of the hood 103 are formed positioning grooves 110 for ribs (not shown) projecting on the mating male connector. Female terminals (not shown) are received in the male connector.

There is a drawback, however, to the above-mentioned conventional structure that, if the hood 3 is caught by some foreign member during, for example, the production of a related wiring harness and a strong pull is caused at the wires 111, the connector 101 may come off of the hood 103. Another drawback is that, if disassembling of the connector 101 and the hood 103 after their combination is allowed for, they need to be fitted with a somewhat reduced fitting force. This, however, often results in the hood 103 getting loose, coming off or inclined relative to the connector 101 with consequent improper connection between the male tabs 107 inside the hood 103 and female terminals of the mating male connector. If, on the contrary, the force with which the connector 101 and the hood 103 are fitted is increased, then it will deteriorate operability in their combining and disassembling. Yet another drawback is that the male contact tabs 107, because of their protrusion out of the connector 101, may interfere with the hood 103, or the like, to get deformed at the time of combining of the connector 101 and the hood 103. Further, the mating male connector can be fitted into the hood 103 even when the hood 3 is in an incompletely combined condition to the connector 101. In such cases, proper connection of the male and female terminals cannot be attained, with consequent electric malfunction of the wiring harness produced.

SUMMARY OF THE INVENTION

This invention has been accomplished to overcome the above drawbacks and an object of this invention is to provide a combined-type connector which enables a connector and a hood to be easily and reliably combined and disassembled, securely keeps the connector and the hood in combined relation, prevents terminals from being deformed, and reliably prevents improper connection to a mating connector when the connector and the hood are in an incompletely combined condition.

In order to attain the object, according to this invention, there is provided a combined-type connector comprising: a hood having at a front half thereof a first connector-fitting chamber and at a rear half a side opening in a direction perpendicular to a connector-fitting direction; and a connector with a connector-fitting section and a terminal-accommodating section, the connector-fitting section having a second connector-fitting chamber formed therein, wherein the connector-fitting section of the connector is inserted through the side opening into combination with the hood, moved in the direction perpendicular to the connector-fitting direction in which the connector is fitted with a mating connector until the first and the second connector-fitting chambers are aligned to form a single connector-fitting chamber for the mating connector.

Preferably, the hood has a rear wall which abuts against an outer side of a rear wall of the connector-fitting section of the connector when the hood and the connector are combined.

Preferably, the hood and the connector-fitting section of the connector internally have respective guides for the mating connector which are aligned longitudinally in the connector-fitting direction on completion of combining of the hood and the connector.

Preferably, the hood is provided with a terminal-accommodating section, the terminal-accommodating sections of the connector and of the hood being placed in alignment when the hood and the connector are combined.

Preferably, the hood has on a rear wall thereof a guide slit in the direction perpendicular to the connector-fitting direction, and the connector has a guide groove for slidingly guiding an edge of the guide slit and thus the hood into comination with the connector.

Preferably, the guide slit and the guide groove are provided with corresponding means to lock the hood and the connector in combined condition.

Preferably, one of the terminal-accommodating sections of the hood and of the connector has a guide rail in the direction perpendicular to the connector-fitting direction, and an opposite one of the terminal-accommodating sections has an engagement groove in which the guide rail slidingly engages.

Preferably, a terminal is accommodated in the terminal-accommodating section of the connector, with a contact tab thereof being protected in the connector-fitting section.

Preferably, terminals are accommodated in the terminal-accommodating sections of the connector and of the hood, with contact tabs thereof being protected in the connector-fitting section of the connector and the hood, respectively, so as to be arranged in upper and lower tiers in the single terminal-accommodating chamber when the connector and the hood are combined.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described in detail with reference to the attached drawings.

FIGS. 1 to 8 show a combined-type connector according to a first embodiment of this invention.

Figure 1:
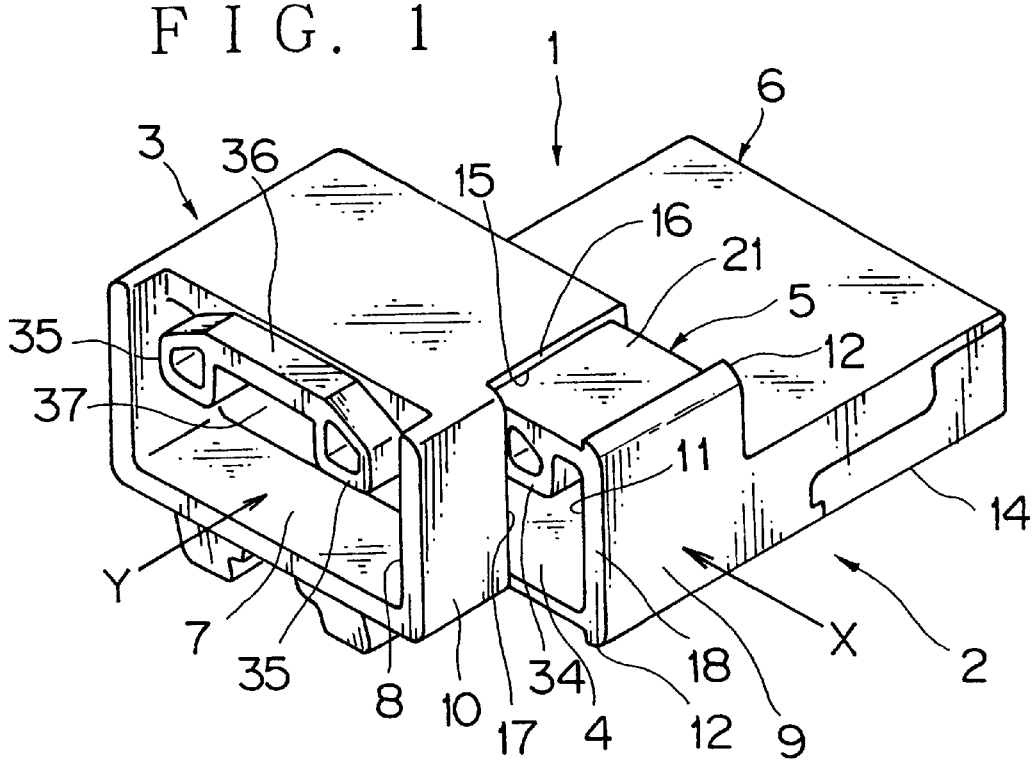
FIG. 1 is a perspective view of a combined-type connector according to a first embodiment of this invention.

The combined-type connector 1, as shown in FIG. 1, consists of a connector 2 of synthetic resin and a hood 3 of synthetic resin into which the connector 2 is at a front half thereof slidingly fitted from a lateral direction as indicated by an arrow X (from a direction perpendicular to a fitting direction Y of the connector 2 towards a mating male connector). Whether the connector 2 is slidingly fitted into the hood 3 or the hood 3 is slidingly fitted over the connector 2 is a matter of relativeness, and either will do.

The connector 2 has at the front half a connector-fitting section 5 of a laterally elongated rectangular shape including a connector-fitting chamber 4 and at the rear half a terminal-accommodating section 6. The connector-fitting section 5 has a smaller size than the hood 3 and is laterally fitted into a rear half of the hood 3. The connector-fitting chamber 4 has a front opening 11 adapted to be continuous with a connector-fitting chamber 7 of the hood 3. A side wall 9 of the connector-fitting section 5 of the connector 2 and a side wall 10 of the hood 3 are of the same thickness, and the front opening 11 of the connector 2 and the front opening 8 of the hood 3 are of the same size and shape.

The connector-fitting section 5 of the connector 2 and the connector-fitting chamber 7 at the front half of the hood 3, in combination, constitute a single connector-fitting section for the mating male connector (not shown). The combined connector 1 works as a female connector. The side wall 9 of the connector-fitting section 5 has a upper and a lower flanges 12 for stopping the sliding of the hood 3. A terminal protector cover 14 of synthetic resin is provided on the terminal-accommodating section 6 of the connector 2 from below.

In one side wall 10 of the hood 3 at the rear half, there is provided a side opening 15 for inserting the connector-fitting section 5 of the connector 2. The upper and lower and rear edges of the side opening 15 are inwardly cut out, and the upper and lower flanges 12 of the connector-fitting section 5 are engageable in the upper and lower cutouts 16, with the front end surface 18 of the side wall 9 of the connector-fitting section 5 abutting against the front edge 17 of the side opening 15.

Figure 2:
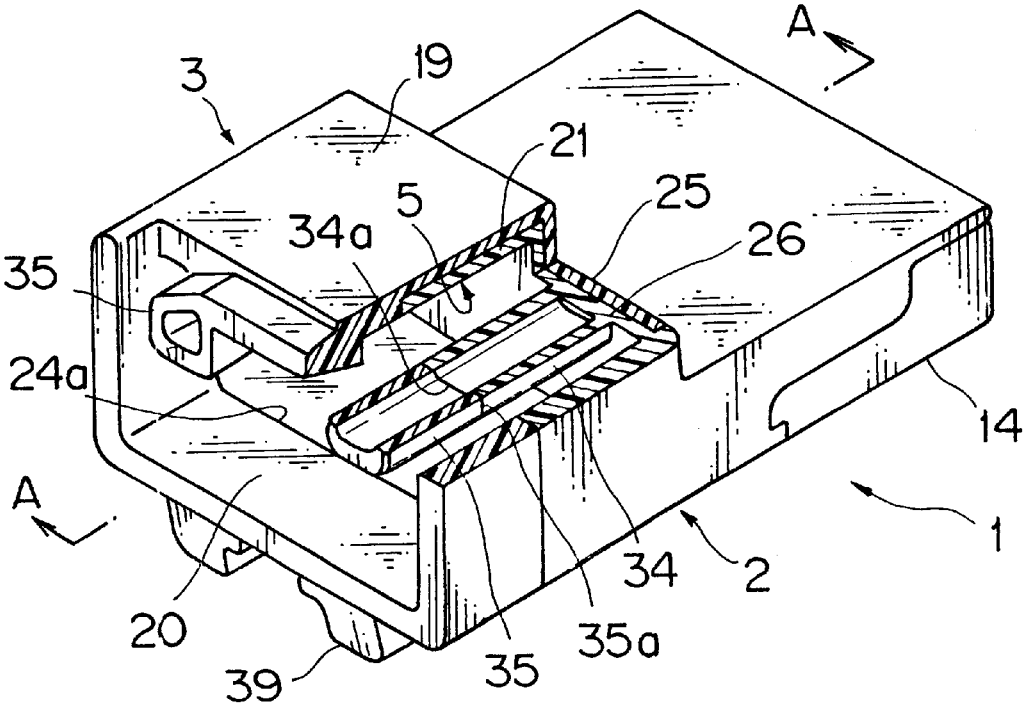
FIG. 2 is a partially broken perspective view of the connector of FIG. 1, shown in combined condition.
Figure 3:
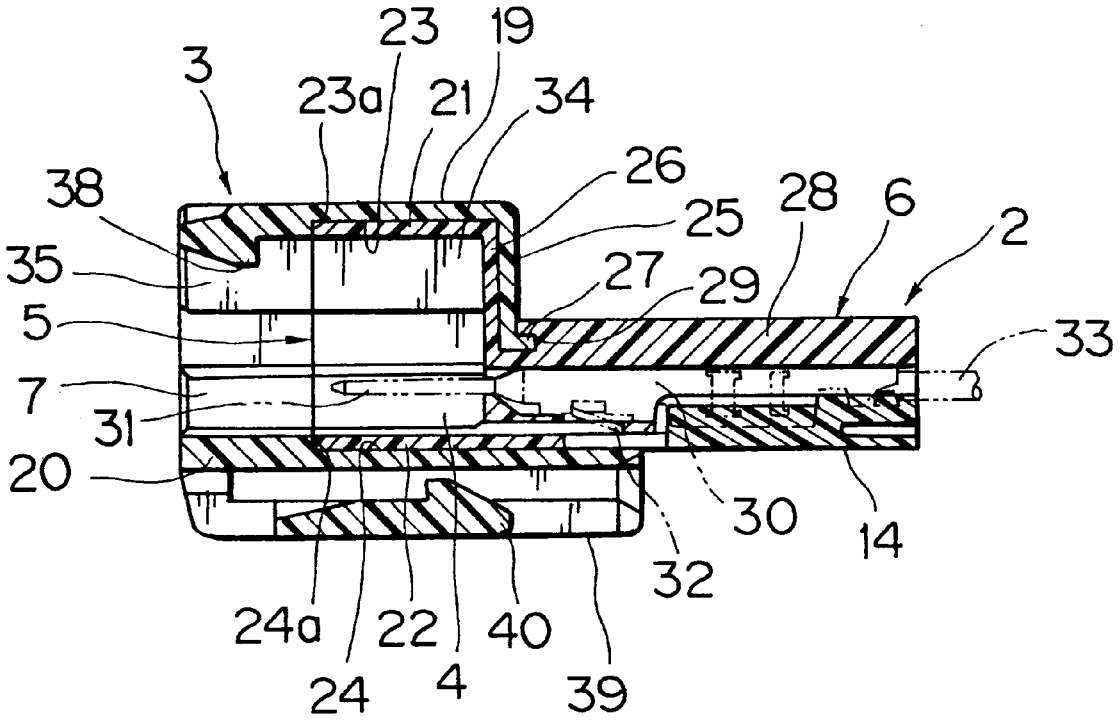
FIG. 3 is a sectional view taken along the line A—A of FIG. 2.

As shown in FIGS. 2 and 3, the upper and bottom walls 19 and 20 of the hood 3 are at their inner sides formed with respective recesses 23 and 24 for receipt therein of the upper and bottom walls 21 and 22 (FIG. 3) of the connector-fitting section 5, with their front ends abutting against shoulders 23*a* and 24*a* of the recesses 23 and 24. The rear wall 25 of the hood 3 extends downwardly in contact with the outer surface of the rear wall 26 of the connector-fitting section 5. The rear wall 25 of the hood 3 has at the lower end a rearwardly-extending rib 27 (FIG. 3) which engages in an engagement groove 29 formed in a width direction of the upper wall 28 of the terminal-accommodating chamber 6 of the connector 2. Simple locking means, such as a locking projection and a corresponding locking hole, may be provided to lock the rearwardly-extending portion 27 in the engagement groove 29.

A male terminal 30 is at a rear half received in the terminal-accommodating section 6 of the connector 2, with its forward male contact tab 31 protruding into the connector-fitting chamber 4 of the connector 2. The male terminal 30 is locked in place in the terminal-accommodating section 6 with a resilient locking lance 32. A wire 33 is attached to a rearward end portion of the male terminal 30. The terminal protector cover 14 is provided so as to cover the wire 33 and double-locks the male terminal 30.

As shown in FIGS. 1 and 2, upwardly inside the connector-fitting chamber 4 of the connector 2 are provided a pair of horizontally arranged hollow guides 34 each in the form of a fallen trapezoid. The guides 34 are provided protrudingly forwardly from the rear wall 26 of the connector-fitting section 5 and lie at the forward end surface 34*a* in the same plane as the front opening 11. A pair of horizontally arranged hollow guides 35 of the same shape are also provided upwardly inside the connector-fitting chamber 7 of the hood 3.

The guides 35 of the hood 3 are located upwardly inside the front opening 8 which receives the mating male connector and continuous to the upper wall 19. That portion of the upper wall 19 where the guides 35 protrude forwardly is cut out. The pair of horizontally arranged guides 35, 35 are interconnected with a horizontal connection wall 36, with a recess 37 formed therebetween for introducing the mating male connector. As shown in FIG. 2, the guides 35 extend rearwardly in the connector-fitting direction to an intermediate length of the hood 3.

The connection wall 36 has a downwardly-directed locking projection 38 (FIG. 3) which engages with a locking arm (not shown) of the mating male connector. Further, the bottom wall 20 of the hood 3 is at the outer side provided with engagement portions 39 which are slidingly engageable with a bracket (not shown), as on a body of a vehicle, and a locking 40 between the engagement portions 39.

As shown in FIG. 2, on completion of combining the hood 3 and the connector 2, their guides 34 and 35 are aligned with each other without a vertical or horizontal positional discrepancy. The forward end 34*a* of the guides 34 of the connector 2 and the rearward end 35*a* of the guides 35 of the hood 3 are brought into contact with each other. On complete alignment of the forwardly and rearwardly located guides 34, 35, as viewed from the front, the mating male connector becomes fully fittable into the combined-type connector 1.

In a combined condition of the connector 2 and the hood 3, the front end surface 18 of the connector side wall 9 abuts against the front edge 17 of the side opening 15 (FIG. 1) of the hood 3; the front ends of the connector upper and bottom walls 21 and 22 abut against the respective shoulders 23*a* and 24*a* of the recesses 23 and 24 of the hood upper and bottom walls 19 and 20; the forward end 34*a* of the guides 34 of the connector 2 abuts against the rearward end 35*a* of the hood guides 35; the connector upper and bottom walls 21 and 22 are in contact with inner surfaces of the hood upper and bottom walls 19 and 20; and the connector rear wall 26 is in contact with the inner surface of the hood rear wall 25. Thus, the connector 2 is stably and firmly held in the hood 3 against a force acting in the connector-fitting or -disassembling direction, without causing rattling or loosening of the hood 3 on the connector 2.

Especially due to the rear wall 25 of the hood 3 contacting the outer surface of the rear wall 26 of the connector 2, the connector 2 does not slip off of the hood 3 even on a strong pull at wires 33 during, for example, the production of a related wiring harness, with the hood 3 locked to a body of a vehicle or the like by means of the locking arm 40.

Because the connector 2 is slidingly inserted into the hood 3 from the direction perpendicular to the connector-fitting direction, there is no force which, at the time of coupling or decoupling the connector 2 and the mating male connector, acts in the direction of sliding the connector 2. Consequently, a smaller locking force of the connector 2 to the hood 3 is sufficient for stably holding the connector 2 in the hood 3. Thus, a simple locking means, as will be described later in conjunction with a second embodiment of this invention, will suffice, simplifying the locking structure.

Further, if the connector 2 and the hood 3 are in an incompletely fitted condition, the guides 34 and 35 of the connector 2 and of the hood 3 will be horizontally discrepant in position relative to each other, thereby causing the forward end of the mating male connector (not shown) inserted into the hood 3 to abut against the forward end 34*a* of the guides 34 of the connector and preventing a further advancement of the male connector into the connector 2. Thus, an incomplete fitting between the connector 2 and the hood 3 can be detected.

In this connection, the mating male connector may be provided with a pair of slide insertion projections (not shown) with tapers at the forward ends which, by being progressively inserted into respective spaces beside the guides 34 and 35, move the incompletely inserted connector 2 to a fully fitted position in the hood 3.

Further, as shown in FIG. 3, because the male contact tab 31 of the male terminal 30 is protected inside the connector-fitting chamber 4 of the connector 2, the male tab 31 does not interfere with the hood 3, or the like, during assembling the hood 3 to the connector 2, thereby precluding deformations or damages to the male tab 31.

FIGS. 4 to 8 show various aspects of the combined-type connector 1 in combined condition.

Figure 4:
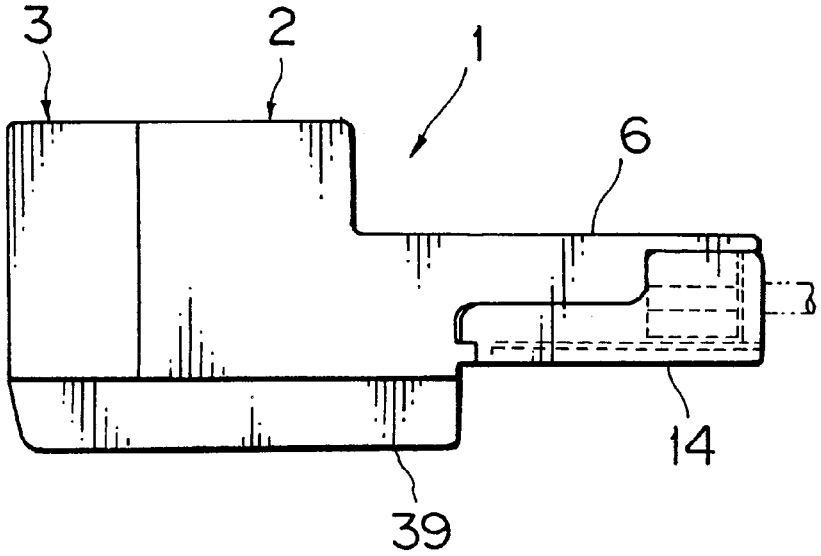
FIG. 4 is a side view of the connector according to the first embodiment of this invention.

As shown in FIG. 4, the connector 2 is integrated with the hood 3 at the rear half of the latter. On the terminal-accommodating section 6 of the connector 2 is put the terminal protector cover 14. The engagement portions 39 at the bottom side of the hood 3 extend along the bottom of the connector 2.

Figure 5:
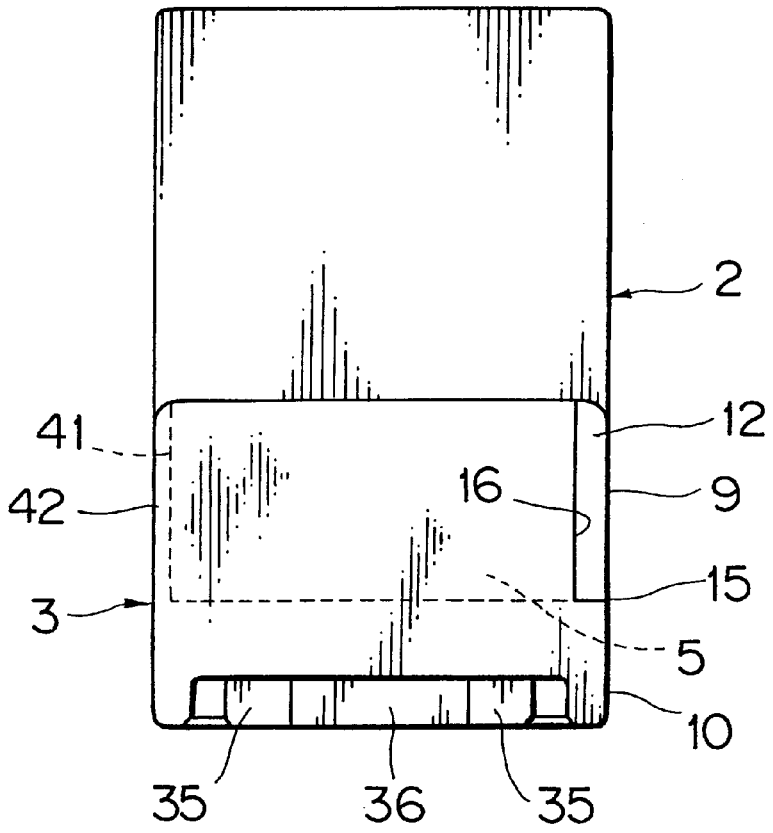
FIG. 5 is a top view of the connector according to the first embodiment of this invention.

As shown in FIG. 5, the sliding insertion leading side side wall 41 of the connector-fitting section 5 of the connector 2 is in contact with the inner surface of hood side wall 42, and the flange 12 of the insertion operating side side wall 9 is received in the cutout 16 at the side opening 15 of the hood 3 to dispose the side wall 9 in the same plane as the side wall 10 of the hood 3. The guides 35 and their connecting wall 36 are located at the forward end of the hood 3.

Figure 6:
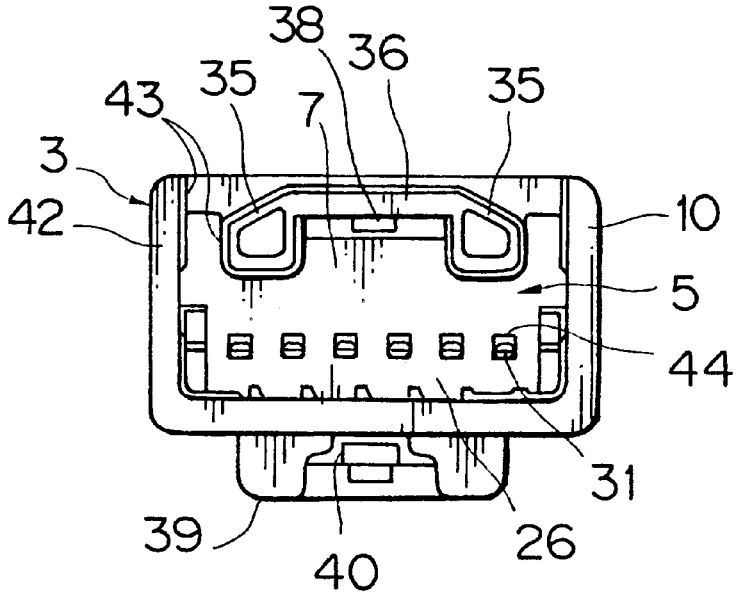
FIG. 6 is a front view of the connector according to the first embodiment of this invention.

As shown in FIG. 6, on outer peripheries at the forward end of the guides 35 and inner surfaces at the forward end of the hood side walls 10, 42 are formed respective guiding chamfers 43. The locking projection 38 is located between the pair of guides 35, 35. The rear wall 26 of the connector-fitting section 5 of the connector 2 is provided with a horizontal row of terminal outlets 44 through which the male contact tabs 31 of male terminals 30 (FIG. 3) protrude. The connector-fitting chamber 7 of the hood 3 and the connector-fitting chamber 4 of the connector 2 are aligned in position to constitute a single connector-fitting chamber, and the hood guides 35 and the connector guides 34 are aligned in position to constitute a single pair of guides. These are aligned without a vertical or horizontal positional discrepancy when viewed from the front. The locking arm 40 is located at a center between the engagement portions 39 at the bottom.

Figure 7:
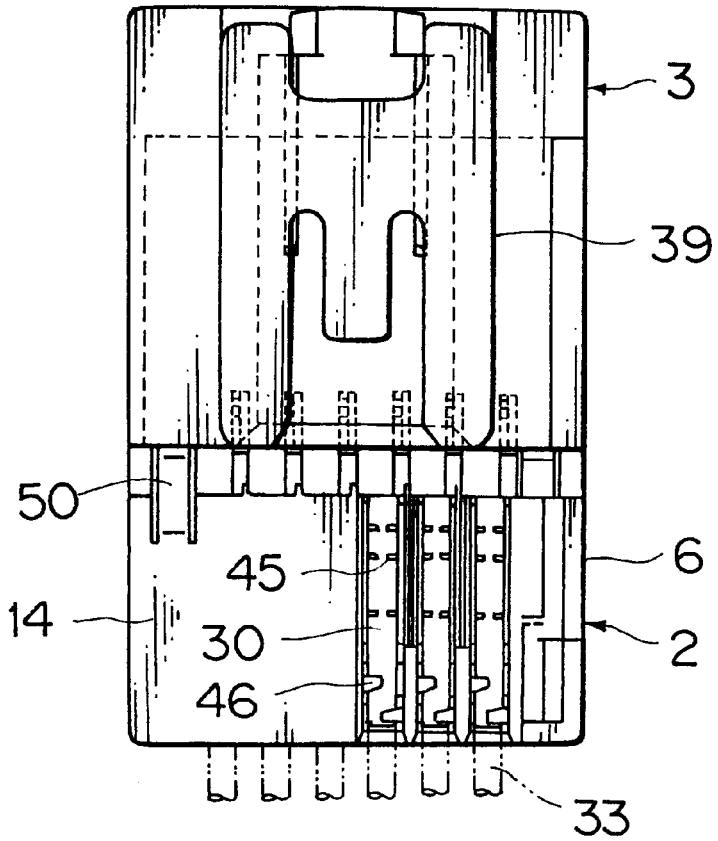
FIG. 7 is a bottom plan view of the connector according to the first embodiment of this invention.

As shown in FIG. 7, the engagement portions 39 extend to the terminal-accommodating section 6 of the connector 2 which contains male terminals 30 in a row arrangement each having contact pieces 45 crimped on the wire 33 and wire-holding pieces 46. The terminal protector cover 14 covers the connections between the male terminals 30 and the wires 33 and is hinged at 50 to the connector 2.

Figure 8:
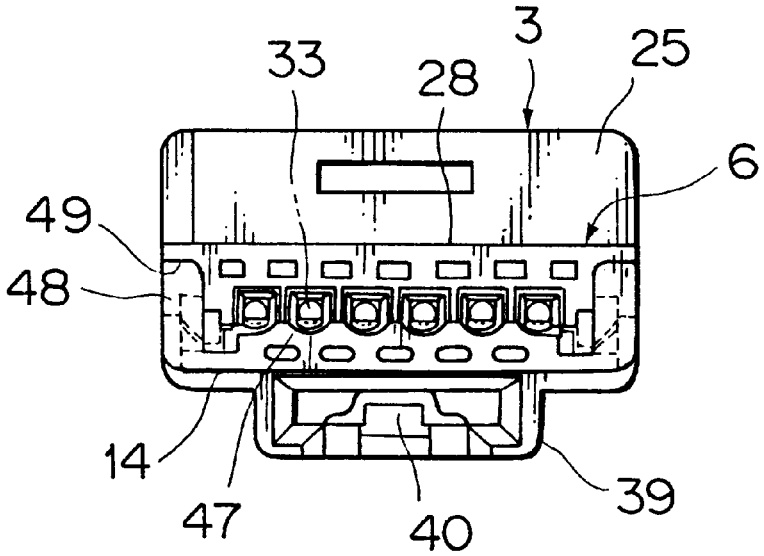
FIG. 8 is a rear view of the connector according to the first embodiment of this invention.

As shown in FIG. 8, the terminal protector cover 14 has a substantially corrugated wire support 47 which presses and keeps the wires 33 in place. The terminal protector cover 14 has opposite side walls 48 engaged in cutouts 49 at opposite sides of the connector 2. The rear wall 25 of the hood 3 extends downwardly to the upper wall 28 of the terminal-accommodating section 6 of the connector 2.

Figure 9:
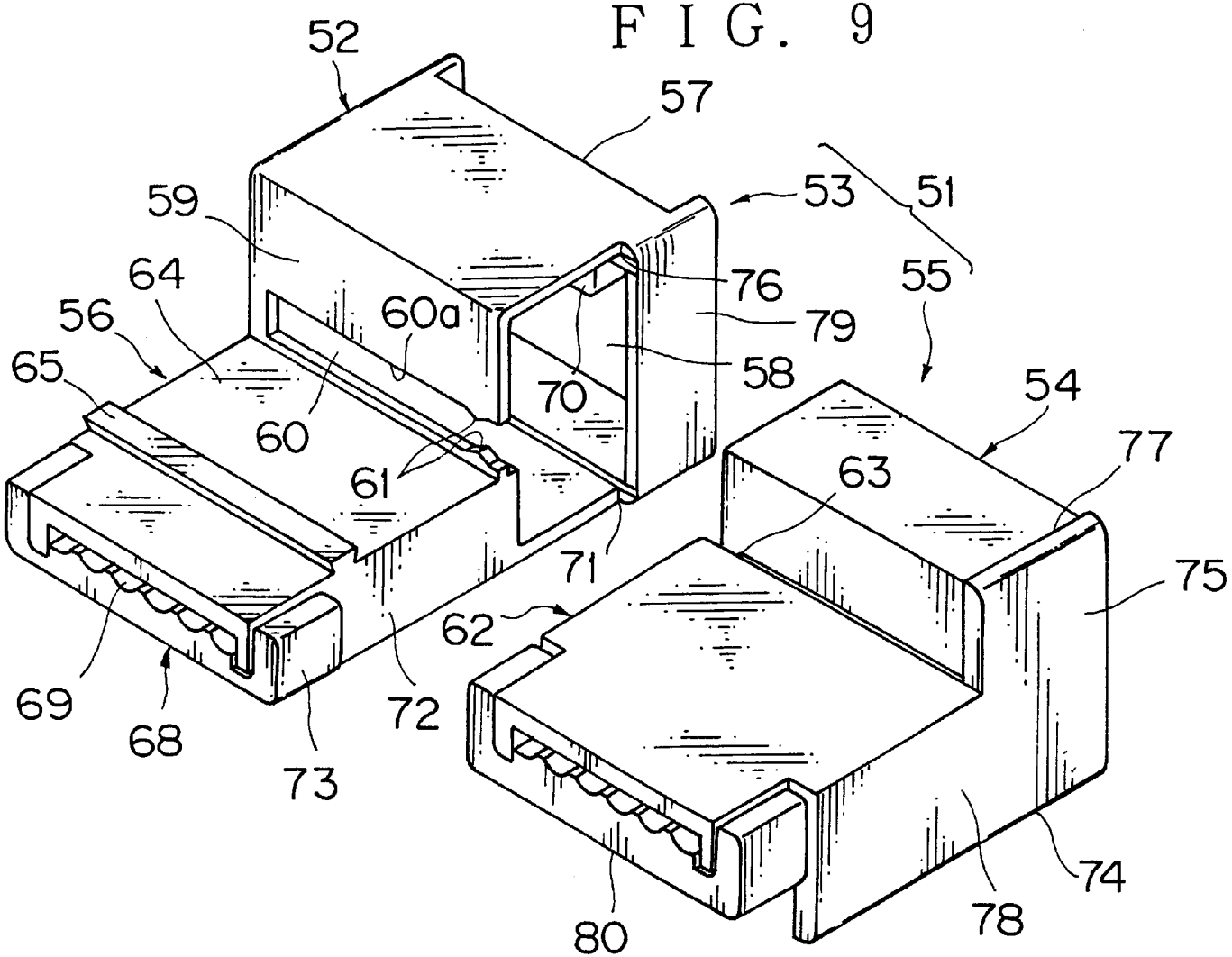
FIG. 9 is a perspective view of a combined-type connector according to a second embodiment of this invention, shown disassembled.
Figure 10:
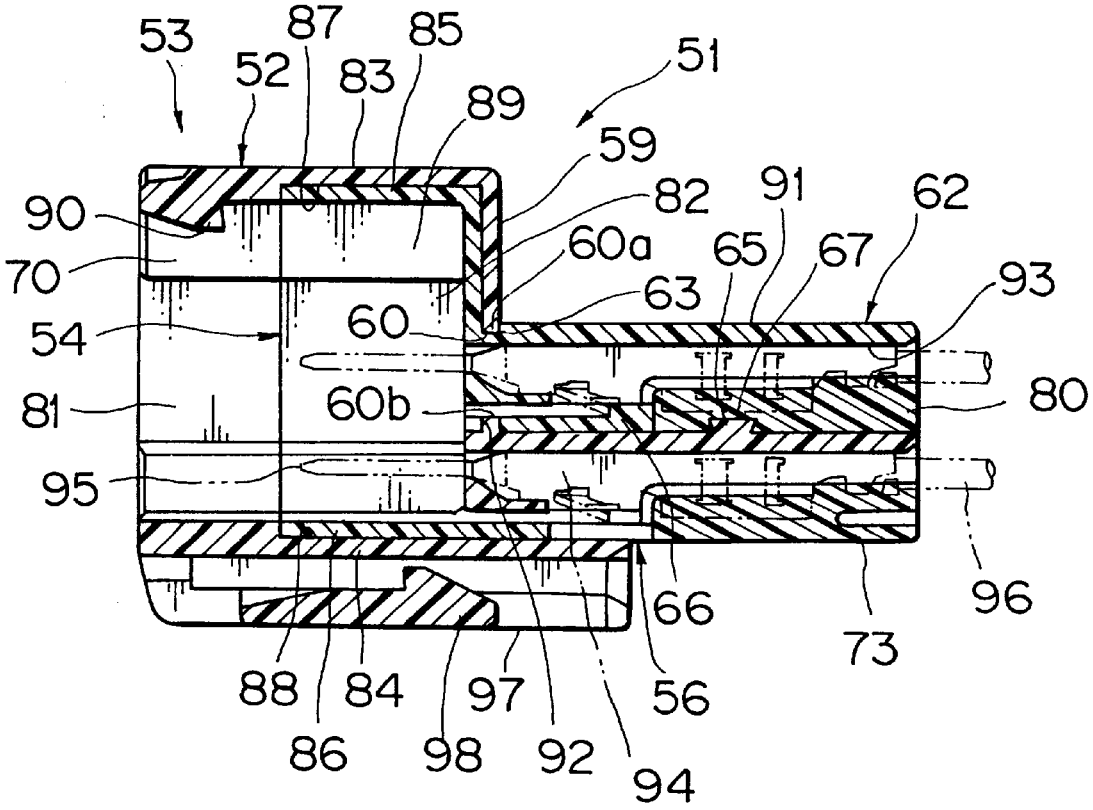
FIG. 10 is a longitudinal sectional view of the connector of FIG. 9, shown in combined condition.
Figure 11:
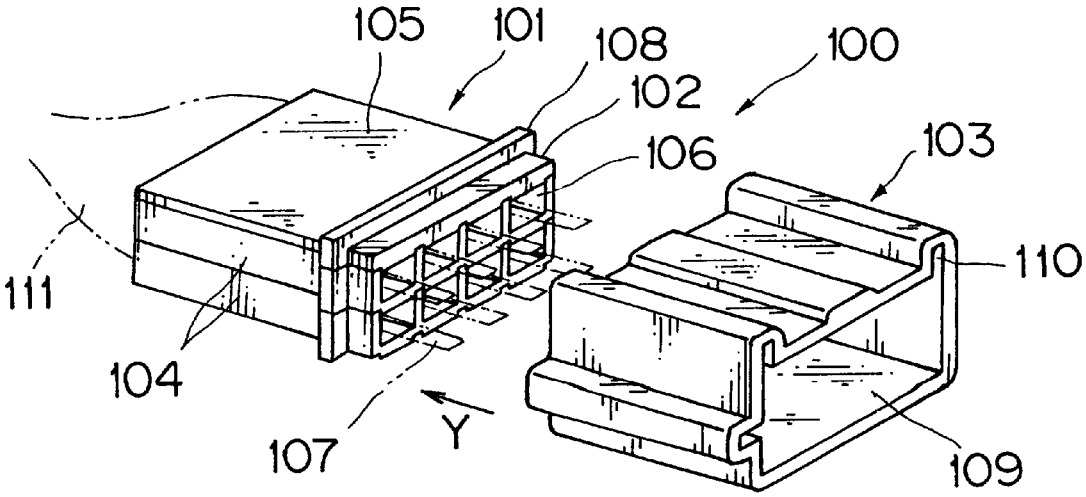
FIG. 11 PRIOR ART
FIG. 11 is a perspective view of a conventional combined-type connector, shown desassembled.

FIGS. 9 and 10 show a combined-type connector according to a second embodiment of this invention.

The combined-type connector 51, as shown in FIG. 9, consists of a first connector 53 of synthetic resin including a hood 52 and a second connector 55 of synthetic resin having a connector-fitting section 54 laterally slidingly insertable into the hood 52 at a rear half thereof (from a direction perpendicular to a fitting direction of the combined-type connector 51 to a not-shown mating male connector).

The hood 52 is larger in height than in the preceding example and is at a lower half thereof integrally provided with a terminal-accommodating section 56 which extends rearwardly in the connector-fitting direction. The hood 52 has a front opening 57 for inserting the mating male connector and a side opening 58 for inserting the connector-fitting section 54 of the second connector. The side opening 58 is located at the rear half of the hood 52.

The rear wall 59 of the hood 52 has a horizontal guide slit 60 extending from the side opening 58 in a width direction of the rear wall 59. The guide slit 60 is at the entrance provided with upper and lower locking projections 61. The guide slit 60 receives the terminal-accommodating section 62 of the second connector 55, with its upper edge 60*a* slidingly engaging in a guide groove 63 extending transversely on a base portion of the terminal-accommodating section 62. The locking projection 61 engages with, for example, a corresponding not-shown locking means such as a locking projection inside the guide groove 63 to lock the second connector 55 against slipping off.

This locking means is a simple and small one, but still sufficient for preventing the second connector 55 from slipping off. This is because, as described in connection with the preceding example, the second connector 55 is slided into the hood 52 from the direction perpendicular to the connector-fitting direction, and there is no force which, at the time of fitting or decoupling the combined-type connector 51 and the mating male connector, acts in the direction of sliding the second connector 55. It is thus attained that the second connector 55 is prevented from coming off of the hood 52 with a small locking force. This locking means is also applicable in the first embodiment of this invention.

On the upper wall 64 of the terminal-accommodating section 56 of the first connector 53 is integrally provided a guide rail 65 of an inverted trapezoidal cross section extending in the sliding direction of the second connector 55, and on the bottom wall 66 (FIG. 10) of the second connector 55 is provided a slide engagement groove corresponding to the guide rail 65. It is also possible to provide the slide engagement groove 67 on the upper wall 64 and the guide rail 65 on the bottom wall 66.

To the underside at the rearward end portion of the terminal-accommodating section 56 is fitted a terminal protector cover 68 with a corrugated wire support 69. Further, a pair of horizontally arranged hollow guides 70 are as in the preceding example provided for the mating male connector (not shown), the guides extending in the connector-fitting direction from the front opening 57 of the hood 52.

The side opening 58 of the hood 52 is at the upper and lower and rear edges cut out, excepting the front edge. The side wall 72 of the terminal-accommodating section 56 is located inwardly so as to lie in the same vertical plane as the cutouts 71 of the side opening 58. The terminal protector cover 68 has one of its side walls 73 located prominent at a rearward end portion of the side wall 72. On the cutouts 71 and the side wall 72 of the terminal-accommodating section 56 is located a downwardly extending side wall 74 of the second connector 55.

The second connector 55 includes a terminal-accommodating section 62 extending rearwardly in the connector-fitting direction from the connector-fitting section 54, which is positioned on top of the connector-accommodating section 56 of the first connector 53. Between the connector-fitting section 54 and the terminal-accommodating section 62 is located the slide guide groove 63 as mentioned above. The terminal-accommodating section 62 is located at an intermediate height of the connector-fitting section 54 so as to be positioned on the terminal-accommodating section 56 of the first connector 53 when both connectors 53, 55 are combined.

The side wall 75 of the connector-fitting section 54 is formed with an upper flange 77 engageable in the upper cutout 76 at the side opening 58 of the hood 52. The downwardly extending side wall 78 of the second connector 55 provides, along with the flange 77, a slide stopper for the second second connector 55. When combined, the side wall 78 lies in the same plane as the side wall 79 of the hood 52. A terminal protector cover 80 is fitted to the underside at a rearward end portion of the terminal-accommodating section 62 as in the first connector 53.

As shown in FIG. 10, when the first and second connectors 53, 55 are combined, the connector-fitting section 54 of the second connector 55 is located inside the hood 52 at the rear half, with their connector-fitting chambers 81 and 82 aligned with each other to constitute a single fitting chamber for the mating male connector (not shown).

The upper and bottom walls 83, 84 of the hood 52 are inwardly formed with respective recesses 87, 88 in which the upper and bottom walls 85, 86 of the connector-fitting section 54 are engaged. Further, the pair of hollow guides 70 as mentioned above are located upwardly inside the hood 52 at the front half. Likewise, the pair of hollow guides 89 are located upwardly inside the connector-fitting section 54 of the second connector 55.

In a combined condition of the first and second connectors 53 and 55, the guides 70 and the guides 89 are located longitudinally aligned with each other. If the first and second connectors 53 and 55 are combined incompletely, the guides 70 and the guides 89 will be located out of the alignment with a horizontal positional discrepancy, so that the inserted mating male connector abuts against the guides 89 of the second connector 55 to prevent the fitting of the combined-type connector 51 and the mating male connector and make the incomplete combination detectable. At a center between the pair of guides 70 of the hood 52 is formed a locking projection 90 for the mating male connector.

The terminal-accommodating sections 56 and 62 of the first and second connectors 53 and 55 are located in a vertical arrangement, the former downwardly of the latter, and combined through engagement of the horizontal guide rail 65 and the engagement groove 67. The engagement groove 67 extends through the upper side protector cover 80. The protector cover 80, along with the bottom wall 66 of the terminal-accommodating section 62 of the second connector 55, rests on the upper wall 64 of the terminal-accommodating section 56 of the first connector 53.

The upper edge 60*a* of the guide slit 60 in the hood rear wall 59 is engaged in the slide guide groove 63 on the upper wall 91 of the terminal-accommodating section 62. The bottom wall 66 of the terminal-accommodating section 62 is formed with a slide engagement groove 92 in which is engaged the lower edge 60*b* of the guide slit 60. The second connector 55 is stably supported on the first connector 53 at two positions of the guide slit 60 and the guide rail 65.

In each terminal-accommodating chamber 93 of each of the upper and lower terminal-accommodating section 62, 56 is contained a male terminal 94, with their male contact tabs 95 protruding in two upper and lower tiers into the connector-fitting chamber 82 of the second connector 55. Each wire 96 is pressed and held in place by the protector cover 73, 80. The thus combined connector 51 is secured to a body of a vehicle or the like by means of the engagement portions 97 and the locking arm 98 on the hood 52.

The combined-type connector 51 of the second embodiment of this invention can accommodate terminals 94 in two upper and lower tiers and has the same advantages as that according to the first embodiment. Further, the combined-type connector 51 is easily adaptable for multipolarization of terminals by combining terminal-accommodating sections one on the other.

Having now fully described the invention, it will be apparent to one of ordinary skill in the art that many changes and modifications can be made thereto without departing from the spirit and scope of the invention as set forth herein.

What is claimed is:

1. A combined-type connector comprising:

a hood defined by substantially rectangularly arranged walls having at a front portion of said hood a first connector-fitting chamber and at a rear portion thereof an opening in a side of one of said walls, said opening extending in a direction perpendicular to a connector-fitting direction through said hood; and a connector containing a connector-fitting section and a terminal-accommodating section spaced from said connector-fitting section in the connector-fitting direction, said connector-fitting section having a second connector-fitting chamber formed therein, wherein said connector-fitting section of said connector is formed to be inserted in a direction perpendicular to the connector-fitting direction through said opening in said side wall of said hood and movable in said direction perpendicular to said connector-fitting direction for fitting combination with a mating connector until said first and said second connector-fitting chambers are mutually aligned to form a single connector-fitting chamber for said mating connector.

2. The combined-type connector according to claim 1, wherein said hood has a rear wall which abuts against an outer side of a rear wall of said connector-fitting section of said connector when said hood and said connector are fittingly combined.

3. The combined-type connector according to claim 1, wherein said hood and said connector-fitting section of said connector each have internal guides for said mating connector which are aligned longitudinally in said connector-fitting direction upon completion of the fitting combination of said hood and said connector.

4. The combined-type connector according to claim 1, wherein said hood is provided with a terminal-accommodating section, said terminal-accommodating section of said connector and of said hood being placed in mutual alignment when said hood and said connector are combined.

5. The combined-type connector according to claim 4, wherein said hood has on a rear wall thereof a guide slit extending in said direction perpendicular to said connector-fitting direction, and said connector has a guide groove for slidingly guiding an edge of said guide slit and thus said hood into combination with said connector.

6. the combined-type connector according to claim 5, wherein said guide slit and said guide groove are provided with cooperating locking means to lock said hood and said connector in combined condition.

7. The combined-type connector according to claim 4, wherein one of said terminal-accommodating sections of said hood and of said connector has a guide rail extending in said direction perpendicular to said connector-fitting direction, and an opposite one of said terminal-accommodating sections has an engagement groove in which said guide rail slidingly engages.

8. The combined-type connector according to claim 1, wherein a terminal is accommodated in said terminal-accommodating section of said connector, with a contact tab thereof being protected in said connector-fitting section.

9. The combined-type connector according to claim 4, wherein said terminal-accommodating sections of said connector and of said hood contain passages to accommodate terminals therein, contact tabs of said terminals being protected in said connector-fitting section of said connector and said hood, respectively, said passages being arranged in upper and lower tiers in said single terminal-accommodating chamber when said connector and said hood are combined.

* * * * *